US005982328A

United States Patent [19]

Drevon

[11] Patent Number: 5,982,328

[45] Date of Patent: Nov. 9, 1999

[54] DEVICE WITH RADIATING ELEMENTS

[75] Inventor: Claude Drevon, Toulouse, France

[73] Assignee: Alcatel Espace, Nanterre Cedex, France

[21] Appl. No.: 08/931,283

[22] Filed: Sep. 16, 1997

[30] Foreign Application Priority Data

Sep. 16, 1996 [FR] France ..... 96 11252

[51] Int. Cl.[6] ..... H01Q 1/38; H01Q 21/00

[52] U.S. Cl. ..... 343/700 MS; 343/853; 343/893

[58] Field of Search ..... 343/7, 893, 852, 343/853, 701, 915, DIG. 2; 342/354; H01Q 1/38, 21/00

[56] References Cited

U.S. PATENT DOCUMENTS

| | | | |
|---|---|---|---|
| 5,262,794 | 11/1993 | Hegazi et al. | 343/770 |
| 5,724,048 | 3/1998 | Remondiere | 343/769 |

FOREIGN PATENT DOCUMENTS

| | | |
|---|---|---|
| 0497249A1 | 8/1992 | European Pat. Off. . |
| 0621653A2 | 10/1994 | European Pat. Off. . |
| 0634808A1 | 1/1995 | European Pat. Off. . |
| 0680112A2 | 11/1995 | European Pat. Off. . |
| 0738023A2 | 10/1996 | European Pat. Off. . |
| 2710195A1 | 3/1995 | France . |

OTHER PUBLICATIONS

A. J. Parfitt et al, "A Chip Scale Approach to Monolithic Microwave Integrated Circuit Antenna Design for Millimeter Wavelength Arrays", Proceedings of The Antennas and Propagation Society International Symposium (APSIS) Chicago, Jul. 20–24, 1992, vol. 4, Jul. 20 1992, Institute of Electrical and Electronics Engineers, pp. 1914–1917, XP000340076.

*Primary Examiner*—Hoanganh Le

*Attorney, Agent, or Firm*—Sughrue, Mion, Zinn, Macpeak & Seas, PLLC

[57] ABSTRACT

A device having radiating elements includes a support structure defining a plurality of unit cells, at least one electronic circuit, connection for supplying at least one input signal to the electronic circuit and at least one radiating element connected to an output of the electronic circuit in order to radiate in response to reception of a signal produced at the output of the electronic circuit. The electronic circuit is encapsulated in a dielectric module to form a microwave electronic module comprising a plurality of unit structures stacked to form a block, each structure comprising a bottom dielectric layer on the top surface of which is disposed an integrated circuit. The radiating element is disposed directly on a first face of the module.

6 Claims, 3 Drawing Sheets

DEVICE WITH RADIATING ELEMENTS

BACKGROUND OF THE INVENTION

1. Field of the Invention

The present invention concerns a device with radiating elements, such as an antenna, and a method of manufacturing a device of this kind. The antenna is intended to be integrated into a satellite, for example.

2. Description of the Prior Art

U.S. Pat. No. 4,987,425 describes an active antenna having a support structure including electronic circuits and radiating elements known as patches. The support structure is made from a carbon fiber material that is metallized on its surface. This support structure defines a plurality of closed unit cells disposed in a matrix in the manner of a "honeycomb". Electronic circuits are disposed inside these cells. The top surface of the support structure supports an antenna body to which the radiating elements are fixed. Each radiating element radiates in response to receiving an output signal produced by an electronic circuit. The bottom surface of the support structure defines a base supporting conductive connecting members for applying input signals to the electronic circuits.

The main disadvantage of the antenna described in the above prior art document is its complex structure, requiring many manufacturing steps.

In order to remedy these drawbacks, a first objective of the invention is to provide a device with radiating elements having a structure which is considerably simplified compared to the prior art. Another objective of the invention is to provide a method of manufacturing a device of this kind comprising fewer steps than prior art methods.

SUMMARY OF THE INVENTION

To this end, the invention consists in a device having radiating elements, including a support structure defining a plurality of unit cells, at least one electronic circuit, connection means for supplying at least one input signal to the electronic circuit, and at least one radiating element connected to an output of the electronic circuit in order to radiate in response to reception of a signal produced at the output of the electronic circuit, wherein the electronic circuit is encapsulated in a dielectric material to form a microwave electronic module comprising a plurality of unit structures stacked to form a block, each structure comprising a bottom dielectric layer on the top surface of which is disposed an integrated circuit, and wherein the radiating element is disposed directly on a first face of the module.

Accordingly, the construction of the device is considerably simplified, in particular in that it does not comprise any antenna body for supporting the radiating elements.

The connecting means advantageously comprise point to point contact means distributed on a second face of the module opposite the first face and on a printed circuit type support to which the support structure is attached.

Additionally, resin can be used to secure the module inside the cell.

The invention further consists in a method of manufacturing a device of the above kind wherein at least one electronic module, on the first face of which is disposed a radiating element, is introduced into a respective cell of a support structure including a plurality of unit cells, and the second face of the at least one module carrying first contact means is attached to the support carrying second contact means so as to establish contact point by point between the first and second contact means.

A resin can be injected into the volume of the cell not occupied by the at least one module to secure the at least one module inside the cell.

Other features and advantages of the present invention will emerge more clearly from a reading of the following description with reference to the corresponding accompanying drawings.

DETAILED DESCRIPTION OF THE PREFERRED EMBODIMENT

The invention is described hereinafter in the specific context of manufacturing an antenna, although it can be applied to the manufacture of any electronic device based on an assembly of parallelepiped-shape modules using a support structure.

Figure 1:
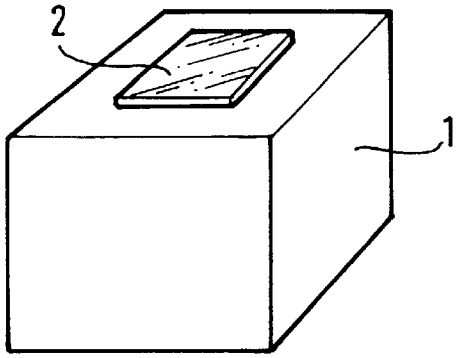
FIG. 1 shows an electronic module used to implement the invention.

Referring to FIG. 1, the invention uses microwave electronic modules 1. Each module 1 comprises at least one microwave electronic circuit encapsulated with a dielectric material to form a block.

Figure 4:
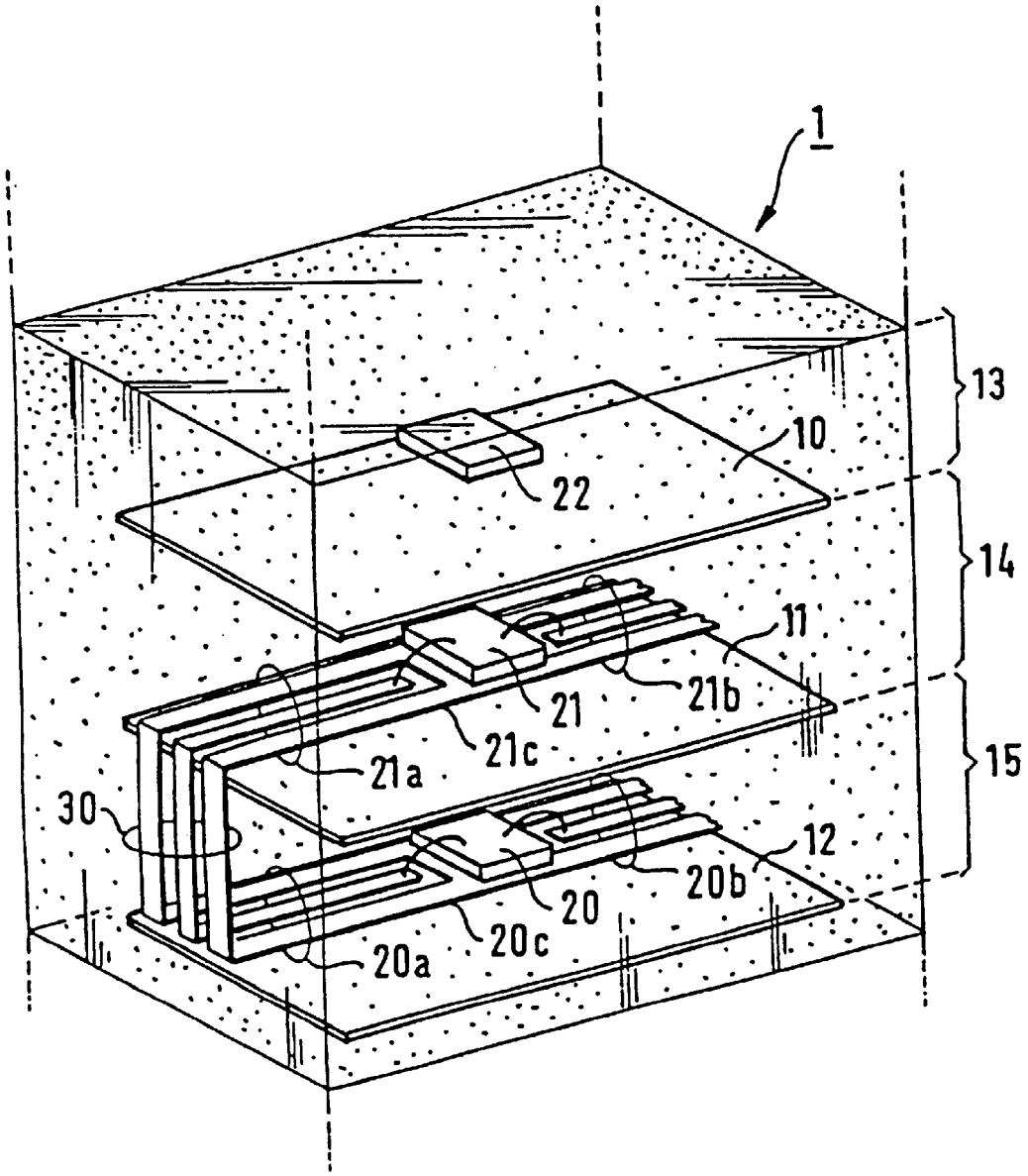
FIG. 4 is a perspective view of a microwave module of the invention, showing a coplanar line link between two integrated circuits.
Figure 5:
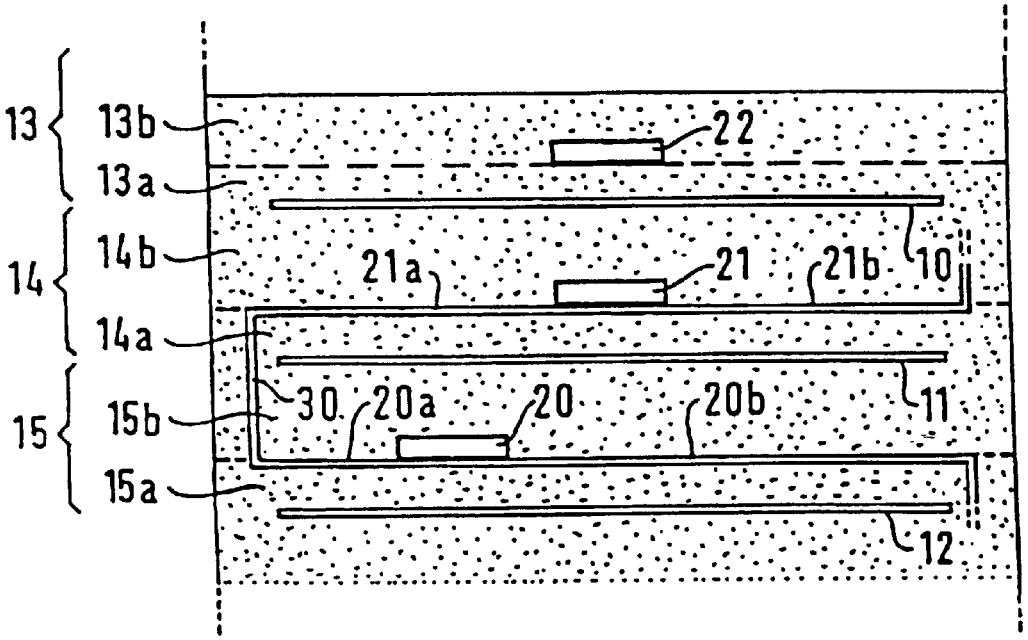
FIG. 5 is a cross-section view of the module shown in FIG. 4.

In one non-limiting embodiment, the module is as described in French patent application No 96-04249 filed Apr. 4, 1996, hereby incorporated by reference. In this embodiment, the module 1 comprises a plurality of stacked unit structures forming a block encapsulated in a dielectric material. Each unit structure comprises a bottom dielectric layer with an integrated circuit disposed on its top surface, with a top dielectric layer covering the circuit. As shown in FIGS. 4 and 5, a microwave module of the invention comprises at least two stacked elementary structures that together form a unit. Each elementary structure comprises one or more integrated circuits, or chips, 20, 21, 22 which are disposed between two layers of dielectric substrate which together form a dielectric casing 15, 14, 13 for the integrated circuit(s) of the elementary structure in question. Thus, by way of example, for the elementary structure containing the circuit 20, said circuit 20 is housed in a dielectric casing 15 made up of a bottom dielectric layer 15*a* on a top surface of which the integrated circuit 20 is disposed, and of a top dielectric layer 15*b* covering said circuit. In practice, it is possible to distinguish between the bottom dielectric layer—15*a*, 14*a*, 13*a*—and the top dielectric layer—15*b*, 14*b*, 13*b*—of each elementary structure because they are built up successively during manufacture of the module, as appears more clearly below. Each elementary structure may be separated from an immediately adjacent elementary structure by a ground plane 10, 11, 12. Between two immediately adjacent bottom and top elementary structures, the ground plane 11 is typically disposed between the bottom dielectric layer 14*a* of the top elementary structure and the top dielectric layer 15*b* of the bottom elementary structure. In FIGS. 4 and 5, the ground plane 11 separates the elementary structure containing the component

20 from the elementary structure containing the component 21. A more detailed description follows of a coplanar line link, in a first embodiment of the invention, between two integrated circuits 20 and 21 belonging to respective ones of two elementary structures. In this coplanar line link, it is assumed that circuit 20 outputs a signal to be applied to the input of circuit 21. In the accompanying figures, the two integrated circuits 20 and 21 belong to respective ones of two elementary structures that are immediately adjacent. However, a person skilled in the art will understand that the circuits 20 and 21 may be separated by one or more other elementary structures. The circuit 21 is mounted on and grounded by a support grounding conductor 21*c*, and it is connected to an input coplanar line 21*a* and to an output coplanar line 21*b*. The support grounding conductor 21*c*, the input coplanar line 21*a*, and the output coplanar line 21*b* are carried by the bottom dielectric layer 14*a* of the elementary structure containing the circuit 21. The support grounding conductor 20*c*, the input coplanar line conductor 20*b* and the output coplanar line conductor 20*a* are carried by the bottom dielectric layer 15*a* of the elementary structure containing the circuit 20. A link intermediate coplanar line 30 sets up a connection between the output coplanar line 20*a* and the input coplanar line 21*a*. A connection for connecting a first integrated circuit mounted on a dielectric layer of a first structure from the plurality of structures to a second integrated circuit mounted on a dielectric layer of a second structure from the plurality of structures comprises (a)—a coplanar input line disposed on the top surface of the bottom dielectric layer of the first structure, (b)—a coplanar output line disposed on the top surface of the bottom dielectric layer of the second structure, and (c)—a coplanar connecting line connecting one end of the coplanar input line and one end of the coplanar output line.

A connection between the output (or input) of the electronic circuit (or of one of the electronic circuits) in a module 1 and a radiating element 2 is assured by a microstrip line (not shown), for example. In accordance with the invention, for at least one of the modules 1 of the antenna, the radiating element 2 is disposed directly on a first face of the module, on the surface of the encapsulating dielectric material, and is fixed (for example glued) to this face of the module. Accordingly, the manufacture of the antenna is based on unit modules each carrying a radiating element 2 on one of its faces.

Figure 2:
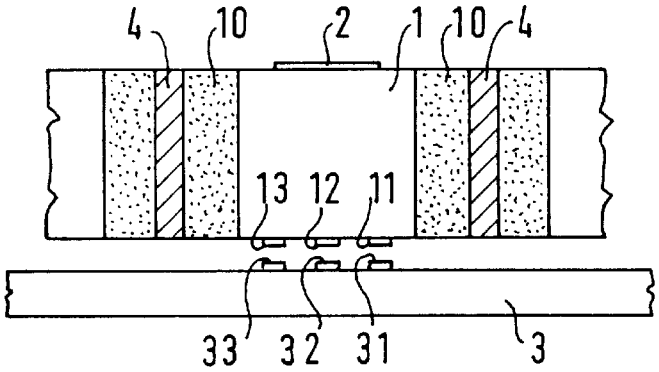
FIG. 2 is a fragmentary cross-sectional view of an antenna in accordance with the present invention.
Figure 3:
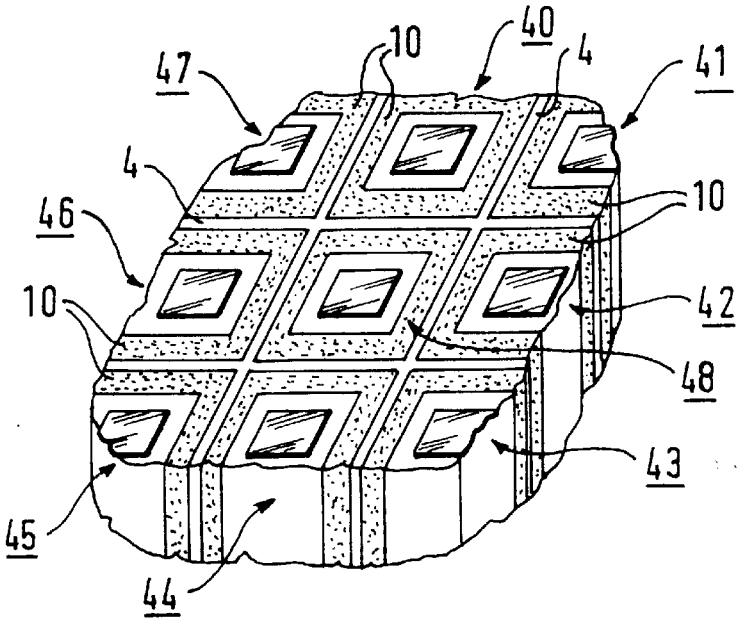
FIG. 3 is a fragmentary plan view of an antenna in accordance with the invention.

Referring to FIGS. 2 and 3, the antenna uses a support structure 4 defining a plurality of open-sided unit cells 40, 41, 42, 43, 44, 45, 46, 47 and 48 and an electronic module 1 and its associated radiating element 2 are introduced into the interior of at least one of these cells. The support structure is made of magnesium, for example, and advantageously has a two-fold function of dissipating heat and providing electromagnetic shielding between the modules 1 introduced into neighboring cells.

The unit cells 40–48 are disposed in a matrix arrangement in the manner of a "honeycomb", each cell being delimited by four walls of the support structure 4 and having the general shape of a parallelepiped.

To manufacture an antenna in accordance with the invention, each module 1, carrying a radiating element 2 on one of its faces, is introduced into a respective cell of the support structure 4. If the module has a volume less than the volume of the cell into which it is introduced, a resin 10, typically a dielectric resin, is introduced into the volume of the cell 40–48 not occupied by the module 1 to secure the module in the cell 40–48. However, each module 1 can be machined so that its volume coincides with that of a cell. In this case no addition of resin is required.

Each module 1 carries contact members 11, 12 and 13 on a face opposite the face on which the radiating element 2 is disposed. The electronic circuits, typically microwave circuits, included in a module 1 receive low-frequency (LF) power supply signals and high frequency (HF) active signals. An electronic circuit in the module 1 is supplied with HF signals by means of coplanar lines, metallized vias, microstrip lines, etc, for example, and a circuit of this kind is supplied with LF signals by means of a two-wire connection. Ends or contact points 11, 12 and 13 of these coplanar lines, metallized vias, wire connections project onto a second face of the module 1 opposite the face on which the radiating element 2 is disposed.

The antenna also includes a printed circuit type support 3 from a main surface of which project ends or contact points 31–33 designed to come into contact with the corresponding projecting contact points 11–13 on the module 1. The contact points projecting from the main surface of the support are ends of coplanar lines, wire connections connected to signal sources generating signals such as power supply signals or HF signals.

To make connections between the contact points 11–13 projecting from the second face of the module 1 and the contact points 31–33 projecting from the main face of the support 3, the support structure 4, into the cells 40–48 of which the modules 1 have previously been introduced, is attached to the support 3 carrying the contact points 31–33 so as to establish contact point by point between the respective contact points 11–13 and 31–33.

There is claimed:

1. A device having radiating elements, including a support structure defining a plurality of unit cells, at least one electronic circuit, connection means for supplying at least one input signal to said electronic circuit, and at least one radiating element connected to an output of said electronic circuit in order to radiate in response to reception of a signal produced at said output of said electronic circuit, wherein said electronic circuit is encapsulated in a dielectric material to form at least one microwave electronic module comprising a plurality of unit structures stacked to form a block, each structure comprising a bottom dielectric layer on the top surface of which is disposed an integrated circuit, and wherein said radiating element is disposed directly on a first face of said module.

2. The device claimed in claim 1 wherein said connecting means comprise point to point contact means distributed on a second face of said module opposite said first face and on a printed circuit type support to which said support structure is attached.

3. A method of manufacturing device as claimed in claim 2 wherein said at least one electronic module, on the first face of which is disposed said radiating element, is introduced into said respective unit cell of said support structure including said plurality of unit cells, and the second face of said at least one module carrying first contact means is attached to said support carrying second contact means so as to establish contact point by point between said first and second contact means.

4. A method as claimed in claim 3 further comprising the step of injecting a resin into a volume of said respective unit cell not occupied by said at least one module to secure said at least one module inside said respective unit cell.

5. A device as claimed in claim 1 further comprising a resin in a volume of a respective one of said unit cells not occupied by said at least one module to secure said at least one module inside said respective unit cell.

6. A device as claimed in claim 1, constituting an antenna.

* * * * *